United States Patent [19]

Aiga et al.

[11] Patent Number: 4,644,225

[45] Date of Patent: Feb. 17, 1987

[54] MAGNETRON

[75] Inventors: Masayuki Aiga, Hyogo; Tetsuji Hashiguchi, Kasai, both of Japan

[73] Assignee: Sanyo Electric Co., Ltd., Japan

[21] Appl. No.: 673,115

[22] Filed: Nov. 19, 1984

[30] Foreign Application Priority Data

Dec. 13, 1983 [JP] Japan ..... 58-235675

[51] Int. Cl.[4] ..... H01J 23/22

[52] U.S. Cl. ..... 315/39.51; 315/39.53; 315/39.65; 315/39.69

[58] Field of Search ..... 315/39.51, 39.53, 39.65, 315/39.69

[56] References Cited

U.S. PATENT DOCUMENTS 4,056,756 11/1977 Derby ..... 315/39.51
4,060,750 11/1977 Tashiro et al. ..... 316/39.51
4,109,179 8/1978 McKinnon ..... 315/39.51

FOREIGN PATENT DOCUMENTS 0202042 12/1982 Japan ..... 315/39.51
1088087 4/1984 U.S.S.R. ..... 315/39.51

*Primary Examiner*—David K. Moore
*Assistant Examiner*—M. Razavi
*Attorney, Agent, or Firm*—Handal & Morofsky

[57] ABSTRACT

The ratio b/a of the width a of the forward end surface 30*a* of each vane 30 to the interval b between the opposed forward end portions of the respective adjacent vanes 30 is set to be not more than 2.3, whereby distribution density of a high-frequency electric field concentrated in the vicinity of the forward end portions of the vane 30 can be equalized.

10 Claims, 16 Drawing Figures

MAGNETRON

BACKGROUND OF THE INVENTION

1. Field of the Invention

The present invention relates to a magnetron, and more particularly, it relates to a magnetron in which vanes are improved in structure.

2. Description of the Prior Art

FIG. 1A is a partially fragmented front elevational view showing structure of a conventional magnetron, and FIG. 1B is a cross-sectional view taken along the line IB–IB in FIG. 1A. FIG. 1C is a cross-sectional view taken along the line IC–IC in FIG. 1B. Referring to these drawings, a magnetron 1 is provided in its center with a cathode 2, which has a filament in the interior thereof for generating electrons. A plurality of panel-shaped vanes 3 are radially arranged to surround the cathode 2. The outer end portions of these vanes 3 are fixed to the inner wall of an anode cylinder 4. A pair of strap rings 5 are fixed to each of upper and lower ends of each vane 3 as shown in FIGS. 1A and 1C, for short-circuiting every other vane 3. A cavity resonator is formed by each of spaces 6 defined by the respective adjacent vanes 3 and the inner wall of the anode cylinder 4 and partially opened toward the cathode 2, so as to determine the oscillation frequency of the magnetron by the resonance frequency of the cavity resonator. A space 7 defined between the vanes 3 and the cathode 2 is called an interaction space. An even direct-current magnetic field is applied to the interaction space 7 in parallel with the central axis of the cathode 2. To this end, permanent magnets 8 are arranged in the vicinity of the upper and lower ends of the anode cylinder 4, respectively. A direct-current or low-frequency high voltage is applied between the cathode 2 and the vanes 3.

In the aforementioned structure, a high-frequency electric field formed in the cavity resonator is concentrated to the forward end portions of the respective vanes 3, and partially leaked into the interaction space 7. An electron group 9 emitted from the cathode 2 rotatingly passes through the interaction space 7 in which the leaked high-frequency electric field and the direct current magnetic field are superposed, whereby interaction takes place between the electron group 9 and the leaked high-frequency electric field and energy of the electron group 9 is supplied to the high-frequency electric field for oscillation. Microwaves obtained by this oscillation are outwardly guided through an antenna 10 which is connected to the vanes 3. Since conversion efficiency to the microwave power, in this case, is not 100%, the energy of the electron group 9 is partially consumed as heat. Therefore, fins 11 are provided along the outer circumference of the anode cylinder 4 for radiation of the heat. It is to be noted that the internal structure of the anode cylinder 4 is shown alone and the fins 11 etc. are not shown in FIG. 1B.

It has been well known in the art that the time of the interaction between the electron group 9 generated from the cathode 2 and the leaked high-frequency electric field is increased as the amount of leakage of the high-frequency electric field is decreased, whereby the conversion efficiency to the microwave power induced in the cavity resonator from the direct input current, i.e., oscillation efficiency is improved.

Japanese Patent Laying-Open Gazette No. 161264/1979, discloses technique of improving oscillation efficiency of a magnetron by reducing leakage of a high-frequency electric field into an interaction space of the same. According to the technical idea disclosed in the subject publication, respective vanes are provided in portions between the forward and outer ends thereof with projections which are opposed with each other with intervals equal to or smaller than the intervals between opposed forward ends of the respective adjacent vanes, so as to concentrate the high-frequency electric field to the subject projections and reduce leakage of the same through the forward ends of the vanes, thereby improving the oscillation efficiency of the magnetron.

Incidentally, distribution density of the high-frequency electric field at the forward end portions of the vanes reaches the maximum at corners of the forward end surfaces of the vanes, and the same applies to even the aforementioned prior art in which merely the leakage of the high-frequency electric field is reduced. Thus, in conventional magnetrons including the aforementioned prior art, remarkable uneveness is caused in the distribution density of the high-frequency electric field in the corners and other portions of the forward ends of the vanes to disturb the interaction between the electron group and the high-frequency electric field, leading to radiation of undesired higher harmonics.

SUMMARY OF THE INVENTION

An object of the present invention is to provide a magnetron in which radiation levels of undesired higher harmonics are suppressed without lowering oscillation efficiency and fundamental harmonic radiation levels.

Briefly stated, the present invention has panel-shaped vanes radially provided along a cathode chamfered at corners of the forward end surfaces thereof, whereby an interval between opposed forward end portions of the respective adjacent vanes is set to be smaller than 2.3 times as long as the width of the forward end surface of each vane.

According to the present invention, distribution density of a high-frequency electric field concentrated in the vicinity of the forward end portions of the vanes can be optimized, and, hence, radiation levels of undesired higher harmonics can be controlled without lowering the oscillation efficiency and fundamental harmonic radiation levels.

The above and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
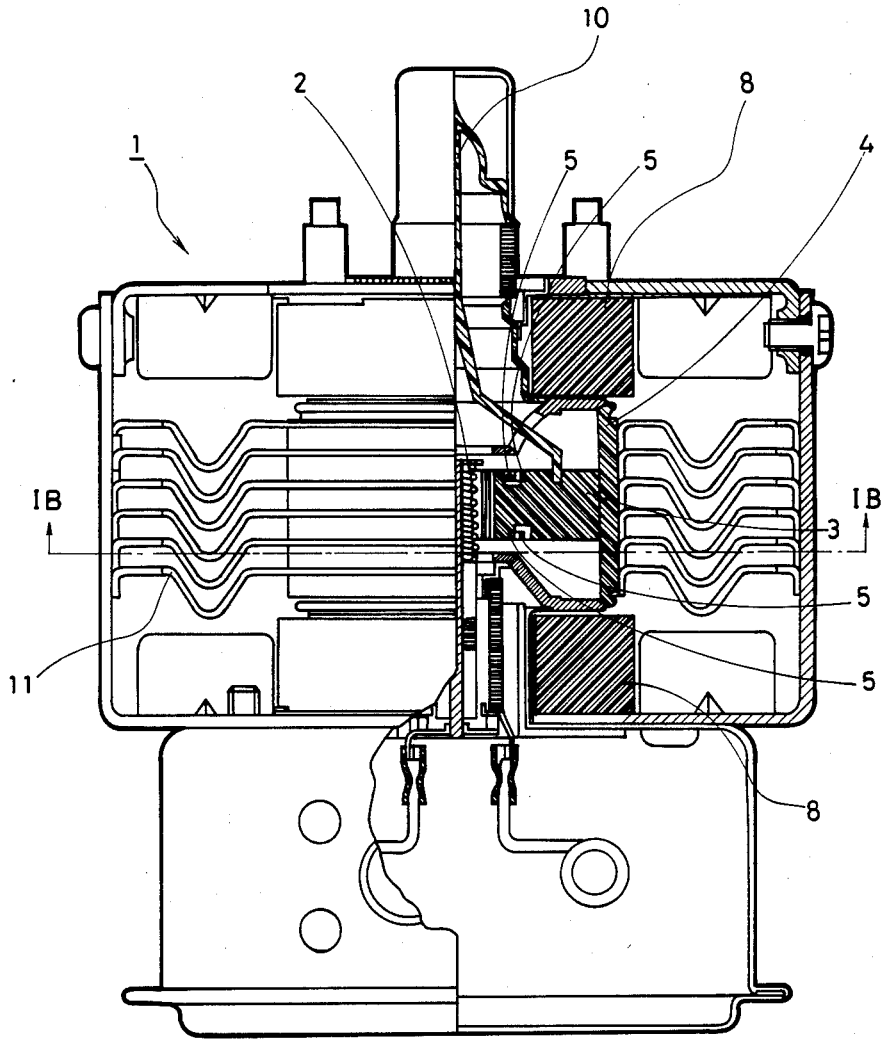
FIG.1A PRIOR ART
FIG. 1A is a partially fragmented front elevational view showing structure of a conventional magnetron.
Figure 1B:
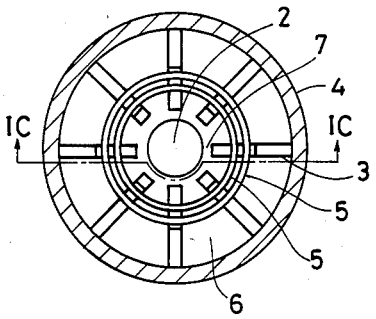
FIG.1B PRIOR ART
FIG. 1B is a cross-sectional view taken along the line IB—IB in FIG. 1A.
Figure 1C:
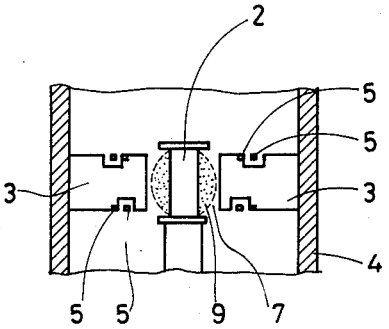
FIG.1C PRIOR ART
FIG. 1C is a cross-sectional view taken along the line IC—IC in FIG. 1B.
Figure 2A:
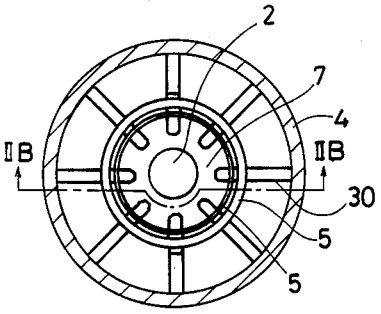
FIG. 2A is a cross-sectional view showing an essential portion of an embodiment of the present invention.
Figure 2B:
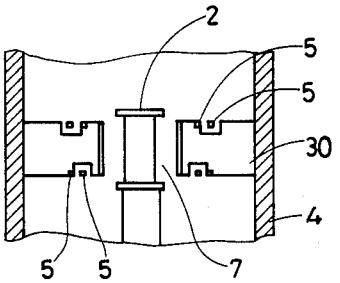
FIG. 2B is a cross-sectional view taken along the line IIB—IIB in FIG. 2A.
Figure 2C:
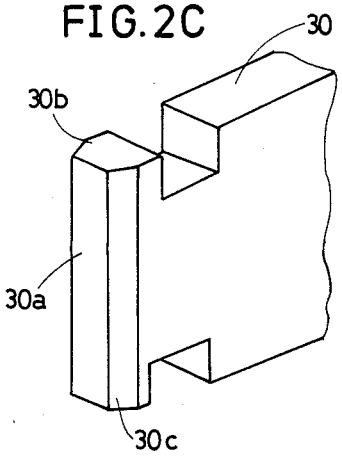
FIG. 2C is an enlarged perspective view showing the forward end portion of a vane employed in the embodiment as shown in FIGS. 2A and 2B.
Figure 2D:
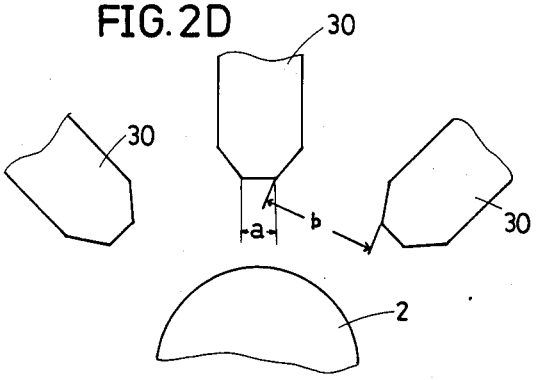
FIG. 2D is an enlarged top plan view showing a cathode and the forward end portions of the vanes in the embodiment as shown in FIG. 2A.

FIGS. 2A to 2D are illustrations showing an embodiment of the present invention. More particularly, FIG. 2A is a cross-sectional view showing an essential portion of a magnetron according to the embodiment of the present invention. FIG. 2B is a cross-sectional view taken along the line IIB—IIB in FIG. 2A. FIG. 2C is an enlarged perspective view showing the forward end portion of a vane employed in the embodiment as shown in FIGS. 2A and 2B. FIG. 2D is an enlarged top plan view showing a cathode and the forward end portions of the vanes in the embodiment as shown in FIG. 2A. The basic structure of the present embodiment is similar to that of the magnetron as shown in FIGS. 1A to 1C, and corresponding components are indicated by the same reference numerals, and explanation thereof is herein omitted. The feature of the present embodiment resides in vanes 30. Namely, in a forward end surface 30*a* of each vane, corners in the direction along the central axis of a cathode 2 are chamfered to form chamfered portions 30*b* and 30*c*. These chamfered portions 30*b* and 30*c* are adapted to equalize distribution density of a high-frequency electric field at the forward end surfaces 30*a* of the vanes 30. In other words, although the high-frequency electric field is remarkably concentrated to the corners of the vane forward ends in the conventional magnetron thereby causing significant difference in the distribution density of the high-frequency electric field between the forward end surfaces and the corners of the vanes, such concentration of the high-frequency electric field is loosened at the subject corners by provision of the chamfered portions 30*b* and 30*c*.

Figure 3:
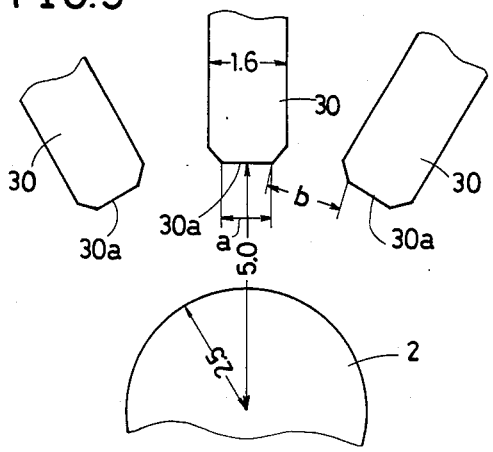
FIG. 3 is an enlarged top plan view showing a cathode and the forward end portions of vanes in a magnetron subjected to an experiment.
Figure 4A:
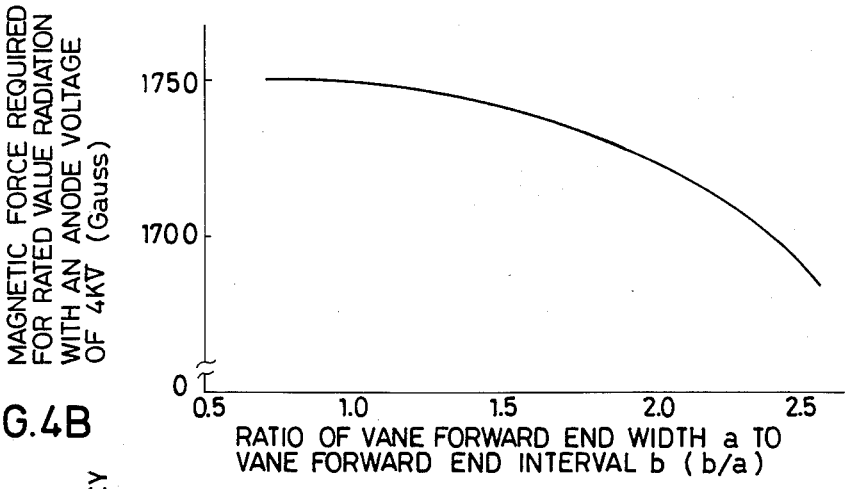
FIG. 4A is a graph showing magnetic force required for rated value radiation with an anode voltage of 4 KV when the ratio of the width of the forward end surface of each vane to the interval between the forward end portions of the respective adjacent vanes is employed as the parameter in the embodiment shown in FIG. 3.
Figure 4B:
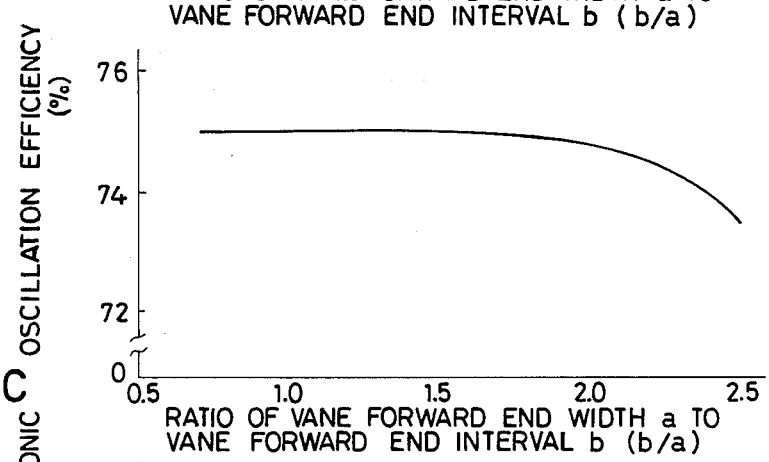
FIG. 4B is a graph showing oscillation efficiency with the ratio of the width of the forward end surface of each vane to the interval between the forward end portions of the respective adjacent vanes being employed as the parameter in the embodiment as shown in FIG. 3.
Figure 4C:
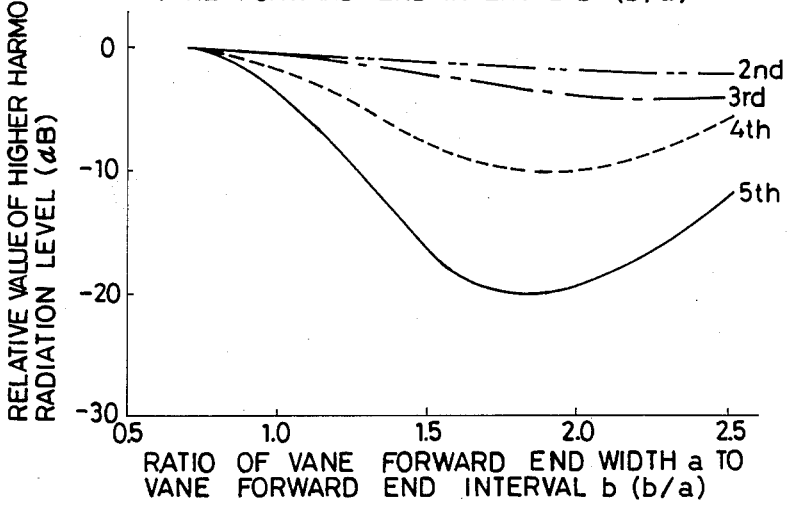
FIG. 4C is a graph showing relative values of higher harmonic radiation levels with the ratio of the width of the forward end surface of each vane to the interval between the forward end portions of the respective adjacent vanes being employed as the parameter in the embodiment as shown in FIG. 3.

Description is now made of the results of an experiment made on the aforementioned embodiment. Although eight vanes 30 are employed in the magnetron as shown in FIG. 2A, the experiment was made utilizing a magnetron, a part of which is shown in FIG. 3, provided with twelve vanes 30. The sizes of respective portions of the vanes 30 and a cathode 2 are as indicated in FIG. 3 in millimeters. In the subject experiment, magnetic force required for rated value radiation with an anode voltage of 4 KV, oscillation efficiency and higher harmonic radiation levels were measured with the ratio b/a of width a of the forward end surface 30*a* of each vane 30 to the interval b between opposed forward end portions of the respective adjacent vanes 30 employed as the parameter. The results are as shown in FIGS. 4A, 4B and 4C, respectively. Each of the graphs as shown in FIGS. 4A to 4C shows the characteristic of the conventional magnetron is shown in the portion at which the ratio b/a is equal to 0.7.

FIG. 4A, shows the change characteristic of the magnetic force required for rated value radiation with an anode voltage of 4 KV in the interaction space 7. According to FIG. 4A, the required magnetic force is decreased as the ratio b/a is increased. Namely, the sizes of magnets can be reduced by increasing the ratio b/a. FIG. 4B shows the characteristic of oscillation efficiency. According to FIG. 4B, the oscillation efficiency is degraded over 1% in comparison with that of the conventional magnetron when the ratio b/a exceeds 2.3. FIG. 4C shows the characteristic of relative values of radiation levels of second to fifth higher harmonics. According to FIG. 4C, all of the radiation levels of the second to fifth higher harmonics are suppressed in comparison with those of the conventional magnetron. The relative values of such radiation levels are again increased when the ratio b/a exceeds 1.9 since the distribution density of the high-frequency electric field concentrated to the vanes 30 are especially concentrated to the forward end surfaces 30*a* thereof.

According to the aforementioned results of the experiment, the ratio b/a of the width a of the forward end surface 30*a* of each vane 30 to the interval b between the opposed forward end portions of each adjacent vanes 30 is preferably under 2.3, and more preferably, within a range of 1.3 to 2.3. Most preferably, the ratio is within a range of 1.5 to 2.0.

Figure 5:
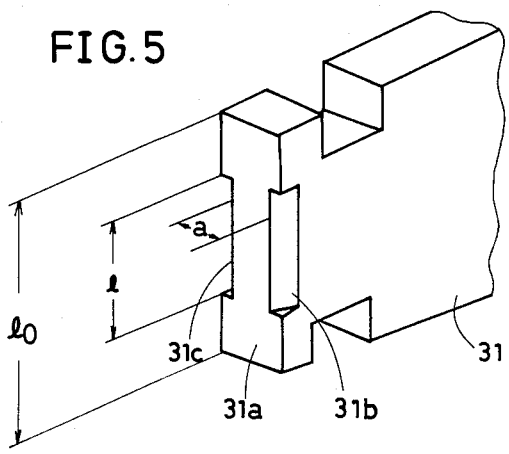
FIG. 5 is an enlarged perspective view showing the forward end portion of a vane used in another embodiment of the present invention.

As shown in FIG. 1C, distribution density of the electron group 9 is not even within the interaction space 7 and concentrates at the central portions of the vanes 3 along the central axis of the cathode 2, i.e., in the vertical direction. Thus, the influence exerted by the concentration of the high-frequency electric field to the forward end corners of the vanes 3 to the aforementioned interaction is maximized at the vertical central portions of the vanes 3 and is relatively small in the vicinity of the upper and lower ends thereof. Therefore, radiation levels of undesired higher harmonics can be considerably suppressed also by a vane 31 as shown in FIG. 5, which is chamfered in portions around its vertical center alone. Description is now made with respect to the results of an experiment made on a magnetron employing the vane 31 as shown in FIG. 5.

In the above described experiment, magnetic force required for rated value radiation with an anode voltage of 4 KV, oscillation efficiency and relative values of higher harmonic radiation levels were measured with the ratio $l/l_0$ of length l of each chamfered portion in the forward end corners of each vane 31 to the overall length $l_0$ of the forward end corner of the vane 31 employed as the parameter. Further, the ratio b/a of the width a of the forward end surface 31*a* of each vane 31 and the interval b between the opposed central forward end corners of the respective adjacent vanes 31 was set to be 1.8.

Figure 6A:
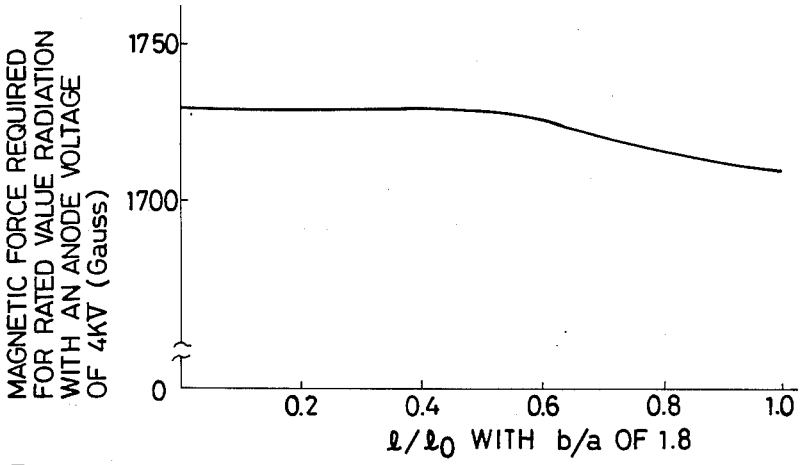
FIG. 6A is a graph showing magnetic force required for rated value radiation with an anode voltage of 4 KV when the ratio of the overall vertical length of the forward end surface of each vane to the length of each chamfered portion is employed as the parameter in the magnetron provided with the vanes as shown in FIG. 5.
Figure 6B:
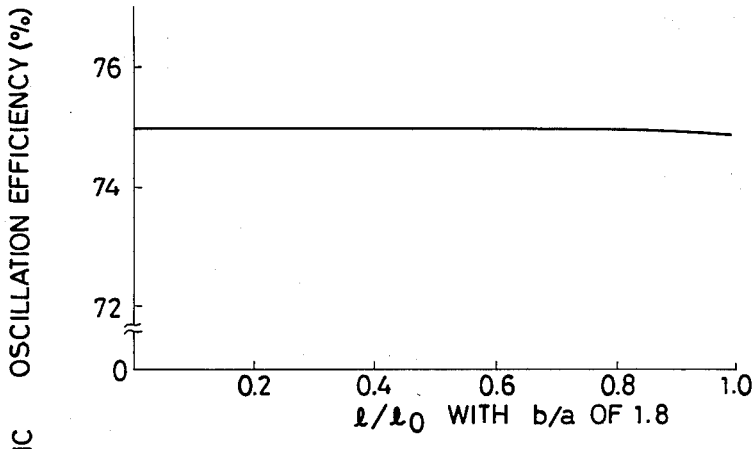
FIG. 6B is a graph showing oscillation frequency with the ratio of the overall vertical length of the forward end surface of each vane to the length of each chamfered portion being employed as the parameter in the magnetron provided with the vanes as shown in FIG. 5.
Figure 6C:
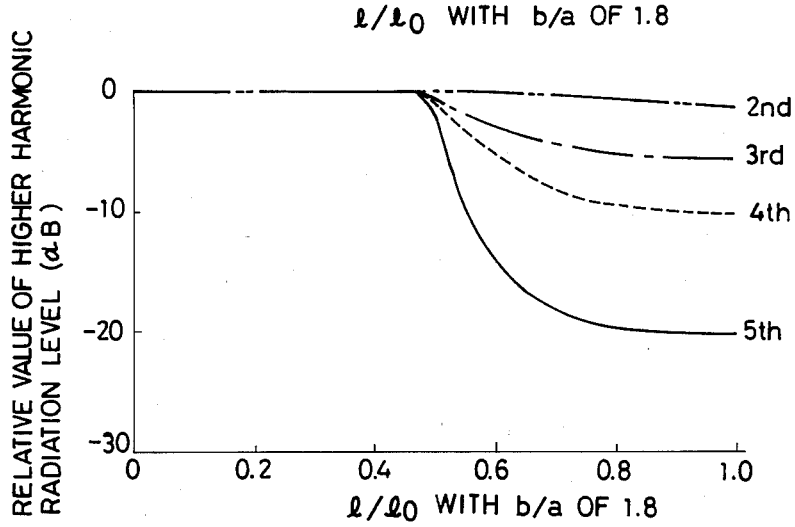
FIG. 6C is a graph showing relative values of higher harmonic radiation levels with the ratio of the overall vertical length of the forward end surface of each vane to the length of each chamfered portion being employed as the parameter in the magnetron provided with the vanes as shown in FIG. 5.

FIGS. 6A to 6C illustrate graphs showing the results of the above experiment, and more particularly, FIG. 6A shows magnetic force required for rated value radiation with an anode voltage of 4 KV, FIG. 6B shows oscillation efficiency and FIG. 6C shows relative values of higher harmonic radiation levels. As seen from FIG. 6A, the magnetic force required for the rated value radiation is decreased as the ratio $l/l_0$ is increased, i.e., as the ratio of occupation by the chamfered portion 31*b* or 31*c* to the overall length of the forward end corner of the vane 31 is increased, whereby the sizes of magnets can be reduced. As seen from FIG. 6B, the oscillation efficiency is not substantially influenced by changes in the ratio $l/l_0$. Further, as seen from FIG. 6C, the higher harmonic radiation levels are remarkably suppressed in portions at which the ratio $l/l_0$ exceeds 0.5. It is to be noted that the ratio $l/l_0$ is equal to 1.0 when the vanes 31 are chamfered along the overall length of the forward end corners, similarly to the vanes 30 as shown in FIG. 2C.

Figure 7:
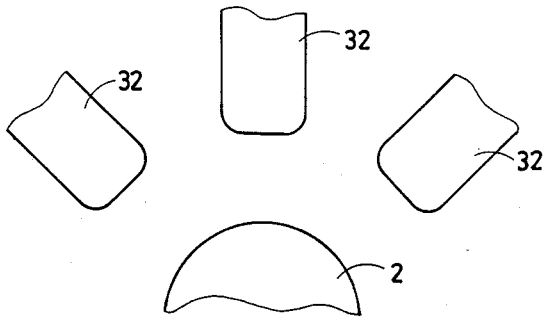
FIG. 7 is a partially enlarged top plan view showing forward end portions of vanes and a cathode utilized in still another embodiment of the present invention.

Although the chamfered portions are formed by flatly cutting the forward end corners of the vanes in the aforementioned embodiments, the same may be formed by roundly cutting the forward end corners of the vanes as in vanes 32 as shown in FIG. 7.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A magnetron which comprises:

a cathode extending in a given direction;

a plurality of panel-shaped vanes radially arranged along the circumference of said cathode so that respective forward end surfaces thereof are opposed to said cathode, said forward end surfaces of the vanes and the lateral side surfaces thereof extending along the upright direction of the cathode being chamfered at corners along said given direction;

an anode cylinder encircling the outer circumferences of said plurality of radially arranged vanes, outer peripheral end surfaces of said vanes being fixed to the inner wall of said anode cylinder; and magnets provided in an interaction space defined between said cathode and said forward end surfaces of said vanes for applying a magnetic field in said given direction, an interval between opposed forward end portions of the respective adjacent vanes being selected to be smaller than 2.3 times as long as the width of said forward end surface of each said vane.

2. A magnetron in accordance with claim 1, wherein said interval between said opposed forward end portions of the respective adjacent vanes is selected to be within a range of 1.3 to 2.3 times as long as said width of said forward end surface of each said vane.

3. A magnetron in accordance with claim 1, wherein said interval between said opposed forward end portions of the respective adjacent vanes is selected to be within a range of 1.5 to 2.0 times as long as said width of said forward end surface of each said vane.

4. A magnetron in accordance with claim 1, wherein each of said vanes is partially chamfered in corners of said forward end surface along said given direction.

5. A magnetron in accordance with claim 1, wherein each of said vanes is chamfered in central portions of said corners of said forward end surface along said given direction.

6. A magnetron in accordance with claim 5, wherein each of said vanes is chamfered in said corners of said forward end surface along said given direction over half overall length of said corners.

7. A magnetron in accordance with claim 1, wherein chamfered portions in each of said vanes are formed as flat surfaces.

8. A magnetron in accordance with claim 1, wherein chamfered portions of each said vane are formed as curved surfaces.

9. A magnetron in accordance with claim 4, wherein chamfered portions in each of said vanes are formed as flat surfaces.

10. A magnetron in accordance with claim 4, wherein chamfered portions of each said vane are formed as curved surfaces.

* * * * *